US007827925B2

(12) United States Patent
Hirayama et al.

(10) Patent No.: US 7,827,925 B2
(45) Date of Patent: Nov. 9, 2010

(54) APPARATUS AND METHOD FOR DROP-DOWN/LIFT-UP BOAT MOUNTED ON MARINE VESSEL

(75) Inventors: Tsugukiyo Hirayama, Yokohama (JP); Takehiko Takayama, Yokohama (JP); Yoshiaki Hirakawa, Yokohama (JP)

(73) Assignee: National University Corporation Yokohama National University, Yokohama (JP)

( * ) Notice: Subject to any disclaimer, the term of this patent is extended or adjusted under 35 U.S.C. 154(b) by 0 days.

(21) Appl. No.: 11/920,240

(22) PCT Filed: May 10, 2006

(86) PCT No.: PCT/JP2006/309771

§ 371 (c)(1),
(2), (4) Date: Nov. 13, 2007

(87) PCT Pub. No.: WO2006/121189

PCT Pub. Date: Nov. 16, 2006

(65) Prior Publication Data

US 2009/0056611 A1 Mar. 5, 2009

(30) Foreign Application Priority Data

May 13, 2005 (JP) ..... 2005-141968

(51) Int. Cl.
*B63B 35/00* (2006.01)
*B63B 35/40* (2006.01)
*B63C 1/00* (2006.01)
*B63C 1/02* (2006.01)

(52) U.S. Cl. ..... 114/258; 114/259

(58) Field of Classification Search ..... 114/258–260, 114/44, 45, 47, 263
See application file for complete search history.

(56) References Cited

U.S. PATENT DOCUMENTS

| | | | | |
|---|---|---|---|---|
| 3,508,510 | A * | 4/1970 | Frankel | 114/260 |
| 3,913,512 | A * | 10/1975 | Kirby et al. | 114/260 |
| 4,147,123 | A * | 4/1979 | Kirby et al. | 114/260 |
| 4,319,540 | A * | 3/1982 | Koskivirta | 114/260 |
| 5,215,024 | A * | 6/1993 | McAllister | 114/45 |
| 6,782,841 | B2 * | 8/2004 | Esposito | 114/366 |
| 2002/0038623 | A1 * | 4/2002 | Irish | 114/259 |

FOREIGN PATENT DOCUMENTS

| | | |
|---|---|---|
| GB | 2054517 | 2/1981 |
| JP | 56-25083 | 3/1981 |
| JP | 61-184194 | 8/1986 |
| JP | 9-071292 | 3/1997 |

OTHER PUBLICATIONS

Microfilm of the specification and drawings annexed to the request of Japanese Utility Model Application No. 48056/1983 (Laid-open No. 151896/1984). Hitatchi Zosen Corp., Oct. 11, 1984. p. 2, line 19 to p. 3, line 15; Fig. 2.

(Continued)

*Primary Examiner*—Ajay Vasudeva
(74) *Attorney, Agent, or Firm*—Jacobson Holman PLLC

(57) ABSTRACT

The present invention provides an apparatus and method of a dock system for launch and recovery of a stowed boat, which is capable of launching and recovering the boat during navigation of a marine vessel at a high headway speed. The launch and recovery apparatus has a stern dock (2) for accommodating the boat (10) therein. The apparatus launches the boat outboard through a stern opening and recovers the boat from the outboard area by entry of the boat into the dock. The apparatus is provided with a conduit device (11) so that seawater surrounding the vessel is drawn through an intake port (12) and is delivered to the dock through an outlet port (13). In the dock, a backward water stream is generated, which is to be discharged outboard through the stern opening.

14 Claims, 13 Drawing Sheets

OTHER PUBLICATIONS

Microfilm of the specification and drawings annexed to the request of Japanese Utility Model Application No. 23345/1990 (Laid-open No. 113294/1991). Mitsubishi Heavy Industries, Ltd., Nov. 19, 1991. p. 8, lines 13 to 17; Fig. 7.

Microfilm of the specification and drawings annexed to the request of Japanese Utility Model Application No., 7536/1990 (Laid-open No. 99695/1991). Director-Generak of the Japan Coast Gurard. Oct. 18, 1991. p. 7, line 12 to p. 8, line 8; p. 9, lines 16 to 20.

* cited by examiner (A)

(B)

(A)

(B)

(A)

(B)

APPARATUS AND METHOD FOR DROP-DOWN/LIFT-UP BOAT MOUNTED ON MARINE VESSEL

TECHNICAL FIELD

This is a national stage of PCT/JP06/309771 filed May 10, 2006 and published in Japanese.

The present invention relates to an apparatus and method for launch and recovery of a boat stowed in a marine vessel, and more specifically, to such an apparatus and method of a dock system in which the boat is contained within a dock located in a stern part of the marine vessel (mother ship).

TECHNICAL BACKGROUND

A miranda system, a slipway system and a dock system are known as typical systems of the launch and recovery apparatus and method, which launch and recover a boat, such as a lifeboat, a rescue boat, or a high-speed surveillance and rescue boat.

The launch and recovery apparatus of the miranda system is known as a miranda davit, in which a davit member is mounted on a deck of a marine vessel, a cradle moves upward and downward on a track of the davit member, and they are used for launching and recovering the boat with the boat being held by the cradle (e.g., Japanese Patent Laid-Open Publications Nos. 56-25083, 61-184194 and 9-71292). Further, the launch and recovery apparatus of the slipway system has an arrangement in which the boat is launched or recovered along a slope provided in a stern part of a marine vessel. The apparatus of the miranda or slipway systems can perform such a launch and recovery of the boat only when the marine vessel stays in a substantially stationary condition.

On the other hand, the dock system is known as a system in which the boat is accommodated in the dock provided at the stern part of the marine vessel and so forth. In general, the launch and recovery apparatus of the dock system includes a stern gate which can open and close. The dock opens backward of the vessel when the gate opens. Since the seawater in the rear of the vessel flows into the dock through the stern opening, a water level necessary for maneuverability of the boat is kept in the dock. Therefore, the boat in the dock can move outboard through the stern opening when the gate opens, and the boat in the outboard area can enter the dock through the stern opening when the gate opens. According to such a launch and recovery apparatus, launch and recovery of the boat through the stern opening can be carried out during headway navigation of the marine vessel.

However, if the gate is opened during high-speed headway navigation, a suction effect expelling the water from the dock occurs, and therefore, the water level in the dock tends to lower. Simultaneously, a flow field in the rear of the vessel tends to rise relative to the water level in the dock, in connection with an affection of propeller race of the marine vessel. The boat has difficulty in entering the dock, owing to such descent of the water level in the dock and elevation of the rear flow field. Therefore, in the conventional dock system, the launch and recovery operation of the boat cannot be carried out during high-speed headway navigation of the vessel, but it is merely possible to perform the launch and recovery operation of the boat only in a condition of low-speed navigation of the vessel (during navigation at headway speeds up to 5 knots).

On the other hand, during low-speed headway navigation or stoppage state of the marine vessel, the water in the dock is kept at rest with respect to the vessel (mother ship), and therefore, rising of the rear flow field does not occur. However, a driving resistance of the boat approaching the dock rapidly decreases immediately after it enters the dock, and therefore, the boat approaching the dock tends to suddenly accelerate immediately after entering the dock, in connection with rapid reduction of the driving resistance. In fact, this results in, e.g., an excessive impact acting on the hull owing to impingement of the suddenly accelerated boat against the end wall of the dock, or difficulty in maneuvers of the boat in the dock. In order to avoid such a situation, it is necessary to promptly and properly control the thrust of the boat at the time of entry of the boat into the dock. However, this imposes a burdensome task on an operator of the boat.

Further, if the gate is opened in a high-wave state, especially in a following-wave state, the waves entering the dock impinge against the end wall of the dock, so that impacts act on the hull. Therefore, it is difficult to launch or recover the boat in such a sea state.

It is an object of the present invention to provide an apparatus and method of a dock system for launch and recovery of a boat stowed in a marine vessel, which can launch and recover the boat while the vessel makes headway at a high speed.

It is another object of the present invention to provide an apparatus and method of a dock system for launch and recovery of a boat stowed in a marine vessel, which can overcome a problem of difficulty in maneuvering of the boat entering the dock of the vessel in low headway speed navigation or stoppage condition; a problem on difficulty in maneuvering of the boat during launch or recovery operation under a following-wave state, and a problem of an impact on a hull or the like occurring in such launch or recovery operation, whereby launch and recovery operation of the boat is facilitated.

DISCLOSURE OF INVENTION

The present invention provides an apparatus for launch and recovery of a boat stowed in a marine vessel, which is provided with a stern dock for containing the boat therein and which is so arranged as to launch the boat outboard through a stern opening of the dock and recover the boat by entry of the boat into the dock; comprising a conduit device which carries out intake of water around the vessel and which delivers the water to the dock so that a backward water stream to be discharged to the outboard area through the stern opening is generated in the dock.

The present invention provides a method for launch and recovery of a boat stowed in a marine vessel, in which the boat contained in a stern dock is launched through a stern opening of the dock to an outboard area and the boat is recovered from the outboard area to the dock by entry of the boat into the dock, wherein an intake of water around the vessel is carried out and a flow of the intake water is delivered to the dock, so that a backward water stream to be discharged through the stern opening to the outboard area is generated in the dock.

According to the arrangement of the present invention as set forth above, a horizontal and backward momentum is given to the stern flow field by the backward water stream discharged rearward through the stern opening, so that rising of the stern flow field is restricted, which may otherwise occur while the vessel makes headway at high speeds. Further, the water level in the dock is raised by the water current delivered into the dock, and therefore, descent of the water level in the dock is restricted, which may be otherwise caused by the suction effect. Thus, the problem of rising of the stern flow field caused during navigation of the vessel at high headway speeds can be overcome, and a desired water level in the dock can be ensured in such navigation of the vessel. Accordingly, the present invention enables the launch and recovery of the boat during navigation of the vessel at high headway speeds.

Further, since the driving resistance due to the backward water stream acts on the boat entering the dock, it is unnecessary for the operator of the boat to perform rapid control of the thrust of the boat, and also, need of difficult steering and turning operations during entry of the boat into the dock is eliminated. In addition, the problem of impingement of the boat against the end wall of the dock can be prevented, since the boat in the dock is subjected to the driving resistance owing to the backward water stream.

Furthermore, the backward water stream is generated in the dock as a countercurrent against the waves entering the dock, and therefore, impacts of the waves impinging against the end wall of the dock can be prevented from occurring.

According to a preferred embodiment of the present invention, the conduit device has a water intake port which opens on a side surface of a hull under a water level for passively receiving a relative water current caused around the vessel by headway navigation of the vessel; an outlet port opening to the dock; and a water conduit for fluid-communication of the intake port with the outlet port. Intake of the water is effected by a dynamic pressure of the relative water current around the vessel and the backward stream is generated in the dock. With such an arrangement, equipment of a power device for forming and ensuring the backward water stream in the dock can be omitted.

According to another preferred embodiment of the present invention, the conduit device has the water intake port which opens on an exterior surface of the hull under the water level; the outlet port opening to the dock; the water conduit for fluid-communication of the water intake port and the outlet port; and a forcible pumping device provided on the conduit for drawing the water through the water intake port and delivering the backward water stream from the outlet port. With such an arrangement, the conduit device draws the water under a suction pressure of the pumping device, and causes a water stream in the dock under a delivery pressure of the pumping device. Therefore, the backward water stream is actively generated in the dock during navigation at low headway speeds or stoppage condition of the vessel.

Preferably, the launch and recovery apparatus is provided with a water level limiting means for discharging the water from the gate to the outboard area when the water level inside of the gate rises over a predetermined limit of the water level. The water level limiting means includes, e.g., an actively or passively operated hatch provided on the gate for limiting the water level, and means for operating the hatch on the basis of detection of the water pressure or the water level in the dock. The water level limiting means allows the water to be naturally or forcibly discharged from the inside of the gate to the outside of the gate, when the inside water level exceeds the predetermined limit.

Basically, the plural outlet ports are disposed on an end wall portion of the dock so as to make the parallel backward streams in the waterway within the dock. However, it is desirable that the outlet ports deliver the backward stream to the waterway in directions oblique to a center axis of the dock, so that centering forces toward the center axis act on the boat.

Preferably, the launch and recovery apparatus has a controller, which controls the water stream in the dock in association with operation of the gate and the headway speed of the vessel. For instance, the controller sets an opening ratio of the water intake port, a flow rate of the pumping device and so forth, in accordance with the headway speed of the vessel; or otherwise, the controller controls opening and closing operation of the water intake port, operation of the pumping device, or the like, in association with timing of operation of the gate. In such arrangements, it is desirable that generation and cessation of the water stream in the dock are controlled in association with operation of the gate, and that augmentation of the water stream in the dock is controlled by a water intake resistance or a pumping power.

BEST MODE FOR CARRYING OUT THE INVENTION

With reference to the attached drawings, a preferred embodiment of the present invention is described in detail hereinafter.

Figure 1:
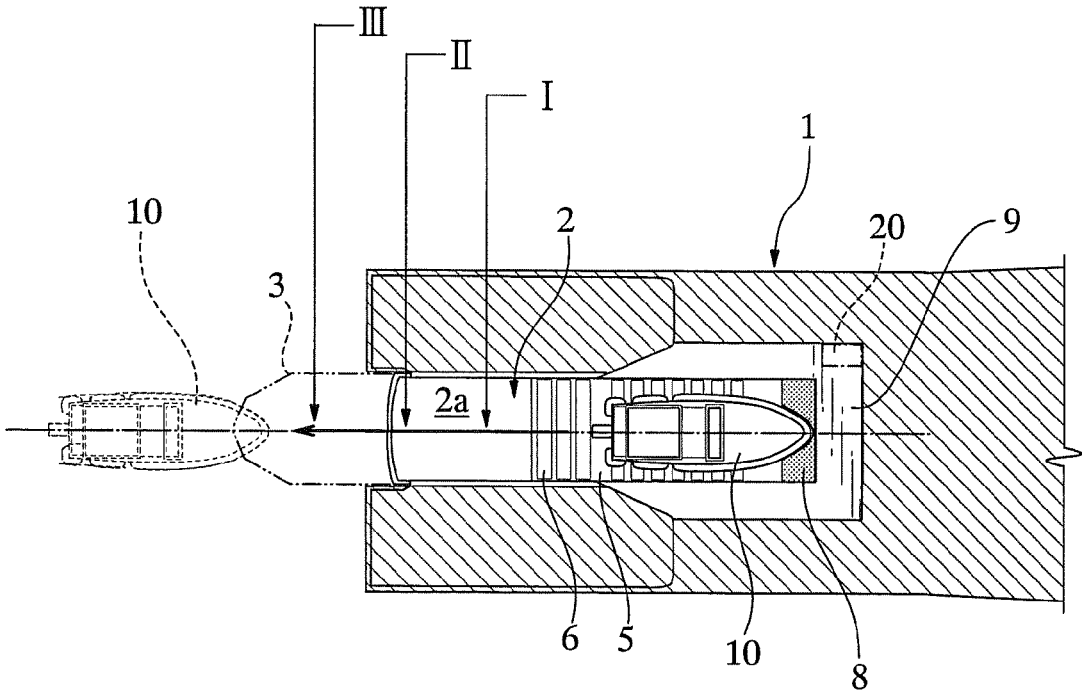
FIG. 1 depicts horizontal and vertical cross-sectional views showing a stern part of a marine vessel provided with a launch and recovery apparatus which is of a conventional dock system, wherein a mode of launching operation is illustrated.
Figure 1:
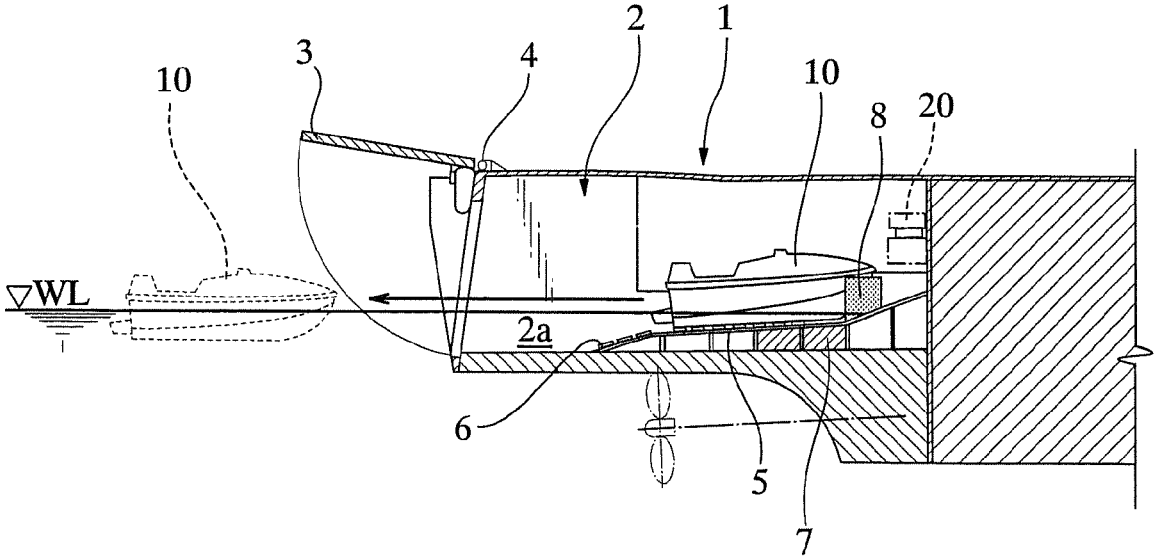
Figure 2:
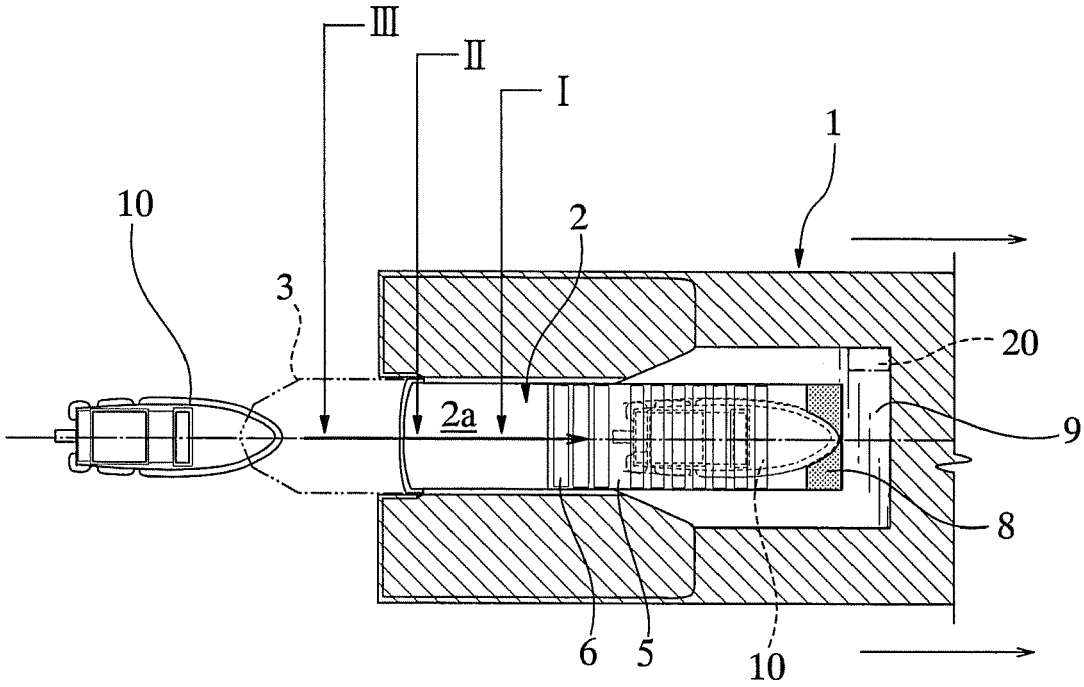
FIG. 2 depicts horizontal and vertical cross-sectional views similar to FIG. 1, which shows the stern part of the vessel provided with the launch and recovery apparatus of the conventional dock system, wherein a mode of recovering operation is illustrated.
Figure 2:
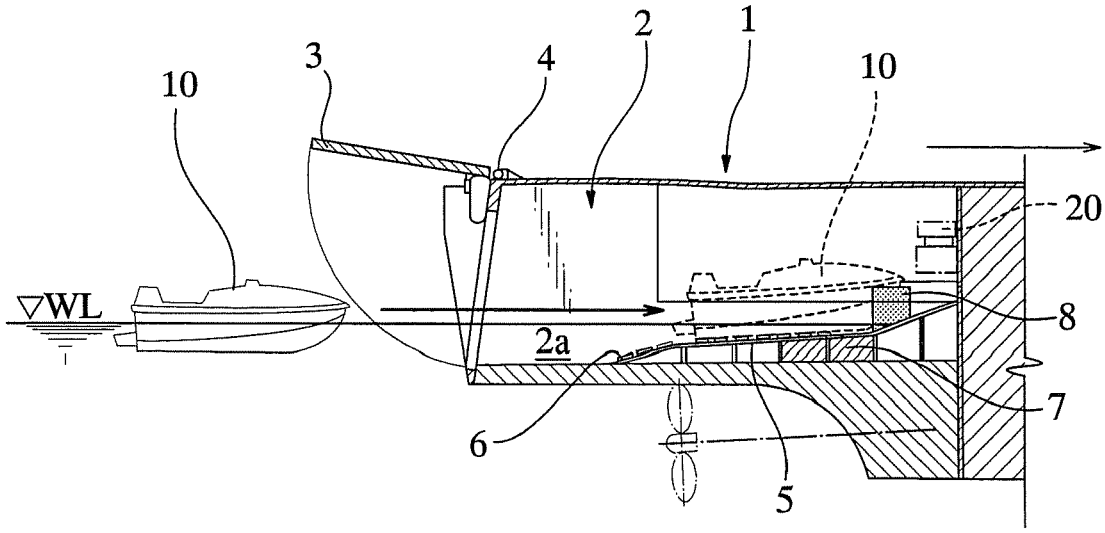

FIGS. 1 and 2 depict cross-sectional views illustrating a stern part of a marine vessel provided with a launch and recovery apparatus of a conventional dock system.

The marine vessel (mother ship) 1 as shown in FIGS. 1 and 2 has a dock 2 in its stern part for accommodating a stowage boat 10. A gate 3 provided on a rear face of the stern part can open the dock 2. A gate operation devise 4 allows the gate 3 to open or close. In a launching or recovering operation, the devise 4 causes the gate 3 to swing to its opening position as shown in FIG. 1(B), whereby the dock 2 opens backward of a hull.

The dock 2 is equipped with a slipway 5 on which the boat 10 can lie. Fenders 6, which function as bumper means, are arranged on the slipway 5. A bumper zone 7 for reliving impacts of waves is located near an end wall of the dock in association with the slipway 5. A stop bumper 8 is further positioned on the end wall. A walkable platform deck 9 is arranged in side and end portions of the dock 2. A power winch 20 (shown by phantom lines) for towing the boat 10 is located on the platform deck 9.

When the boat 10 is to be launched from the stern, the gate 3 is opened in a stoppage state of the vessel 1 or its state of low headway speed navigation up to 5 knots. The boat 10 departs from the slipway 5 to move backward relative to the vessel 1. Thus, the boat 10 makes a relative motion toward the outside of the dock, as shown by dotted lines in FIG. 1.

On the other hand, when the boat 10 is to be retrieved to the stern, the boat 10 enters the dock from the rear of the hull in a stoppage state of the vessel 1 or its navigation state at low headway speeds up to 5 knots, as shown in FIG. 2. In such a state of the vessel 1, a water level WL of the seawater surface coincides with a water level in the dock, if the sea is in a smooth condition without high waves, following waves or the like. It is possible to disregard change of water current occurring when the boat 10 enters the dock (change of resistance acting on the boat 10 entering the dock). Therefore, the boat 10 can smoothly enter the dock through the stern opening. A bow part of the boat 10 impinges against the bumper 8 and the boat 10 lies on the slipway 5. Thus, the boat 10 is recovered in the dock, as shown by the dotted lines on FIG. 2.

Figure 6:
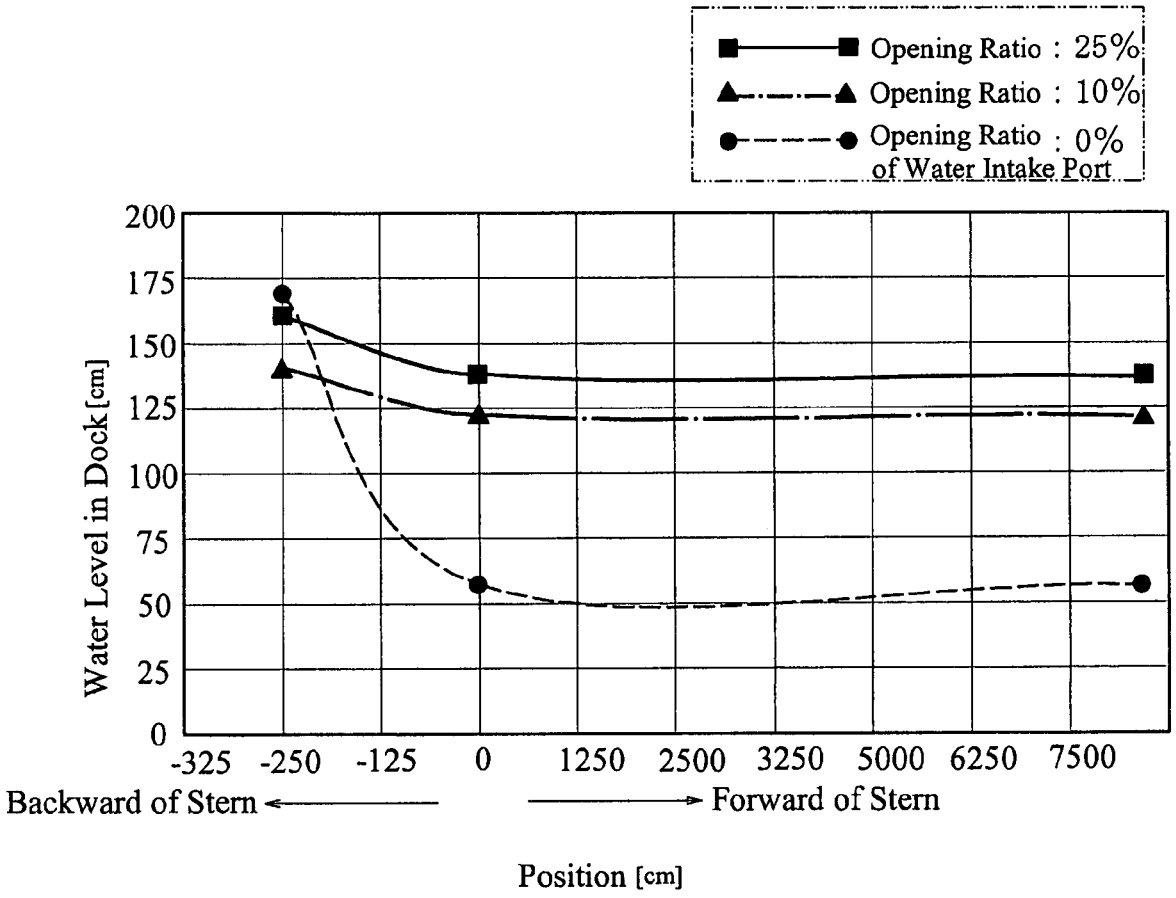
FIG. 6 is a graphic diagram showing water levels inside and outside of a dock, which appears in a high-speed headway navigation, wherein the water levels are indicated as variations taken along the axial direction of the dock.

FIG. 6 is a graphic diagram showing characteristics of changes of the water levels in the dock and near the gate, which appear when the vessel makes headway at a high speed (at 20 knots forward speed). The water level is indicated in FIG. 6, which is measured along an axis of the dock 2 (in a lengthwise direction of the vessel). The reference of the positional indication (the transverse axis), i.e., "position=0 cm", is at a flow field II of the gate as shown in FIGS. 1 and 2. Positions in the dock (in a flow field I inside of the dock as shown in FIGS. 1 and 2) are indicated by positive values (cm), whilst positions outside of the dock (in a flow field III outside of the dock as shown in FIGS. 1 and 2) are indicated by negative values (cm). Further, the reference of the water level ("water level=0 cm") is a level of a bottom surface of the dock.

In FIG. 6, variation of the water level in the dock 2 with the conventional arrangement is indicated by a line (a dotted line) of "opening ratio=0%". When the gate 3 is opened in headway navigation at high speeds, the water level of the flow field I remarkably lowers in comparison with the water level of the flow field III, as shown by the dotted lines ("the opening ratio=0%") in FIG. 6, and therefore, a significant rising of seawater occurs near the flow field II at the gate.

Figure 7:
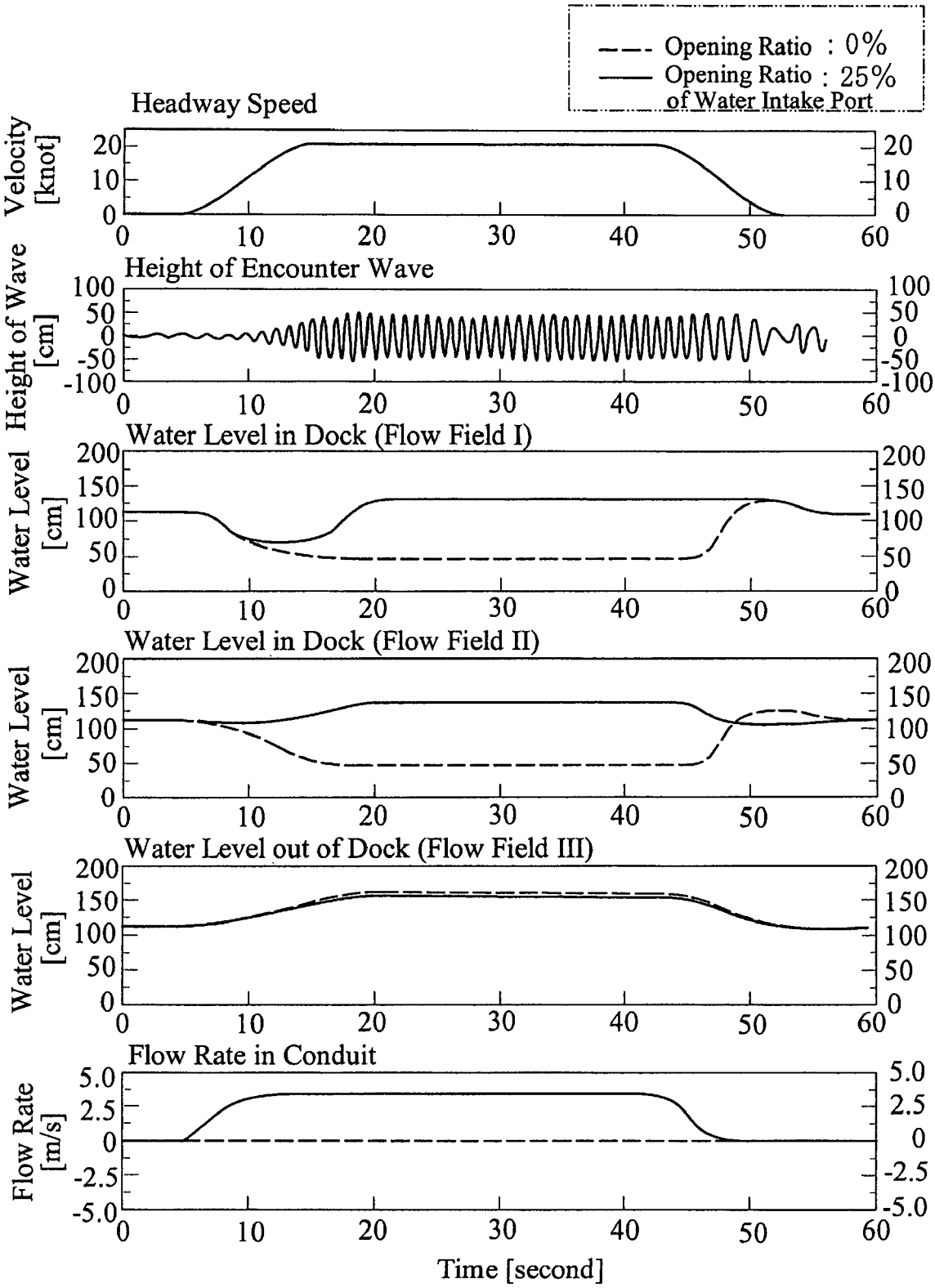
FIG. 7 depicts graphic diagrams showing relationships between the headway speed of the vessel and the water level.

FIG. 7 depicts graphic diagrams showing relationships between the headway speed of the marine vessel 1 and the water level. The reference of the water level ("water level=0 cm") is the level of the bottom surface of the dock, similarly to FIG. 6.

If the headway speed is increased with the gate 3 being opened, the water level of each of the flow fields I, II remarkably lowers, owing to a suction or suction effect outwardly inducing the water of the dock through the opening of the dock. In connection with such an action, the seawater near the opening of the dock rises to elevate the water level outside of the dock. As the result, relatively significant rising of the seawater surface occurs in the flow field II near the gate, as previously described.

Such rising of the seawater surface makes it difficult to launch or recover the boat 10. In fact, the conventional launch and recovery apparatus as shown in FIGS. 1 and 2 cannot launch nor recover the boat 10 while the vessel 1 makes headway at a high speed.

Figure 3:
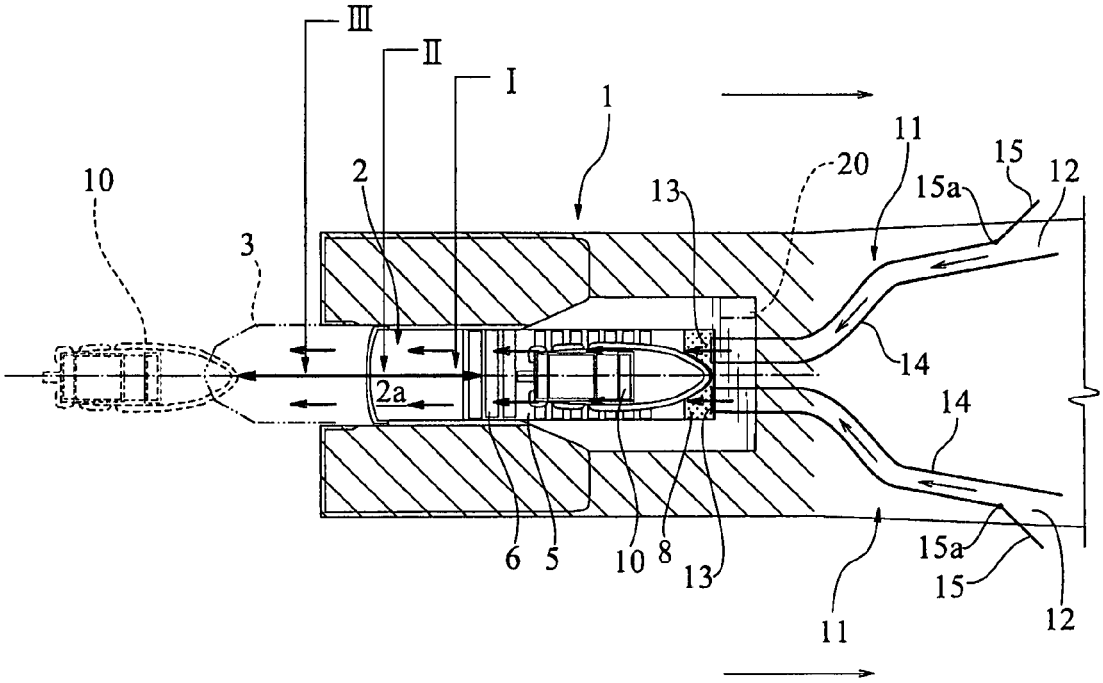
FIG. 3 depicts horizontal and vertical cross-sectional views showing the stern part of the marine vessel which is provided with the launch and recovery apparatus according to the present invention.
Figure 3:
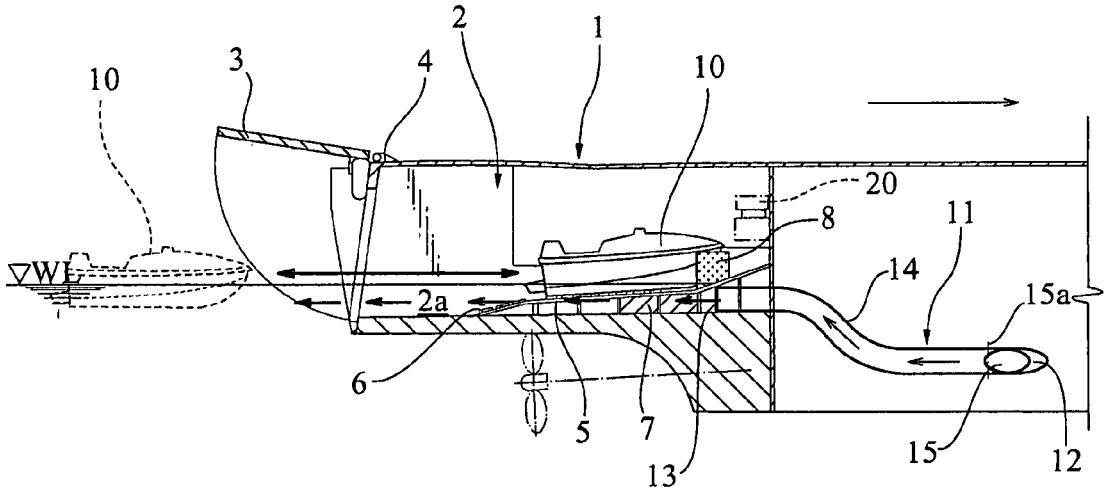
Figure 4:
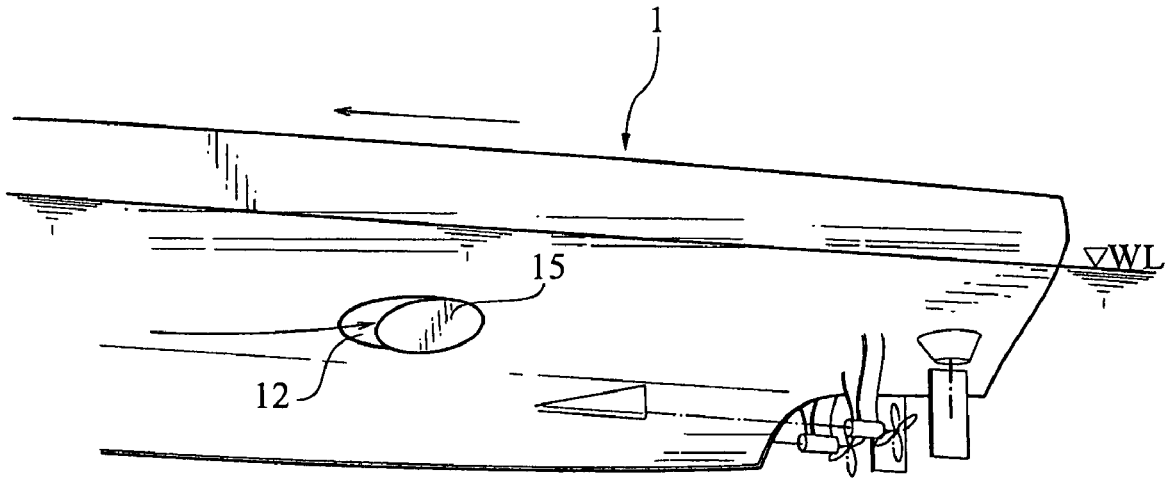
FIG. 4 is a perspective view illustrating a position and arrangement of a water-intake port of the launch and recovery apparatus as shown in FIG. 3.
Figure 5:
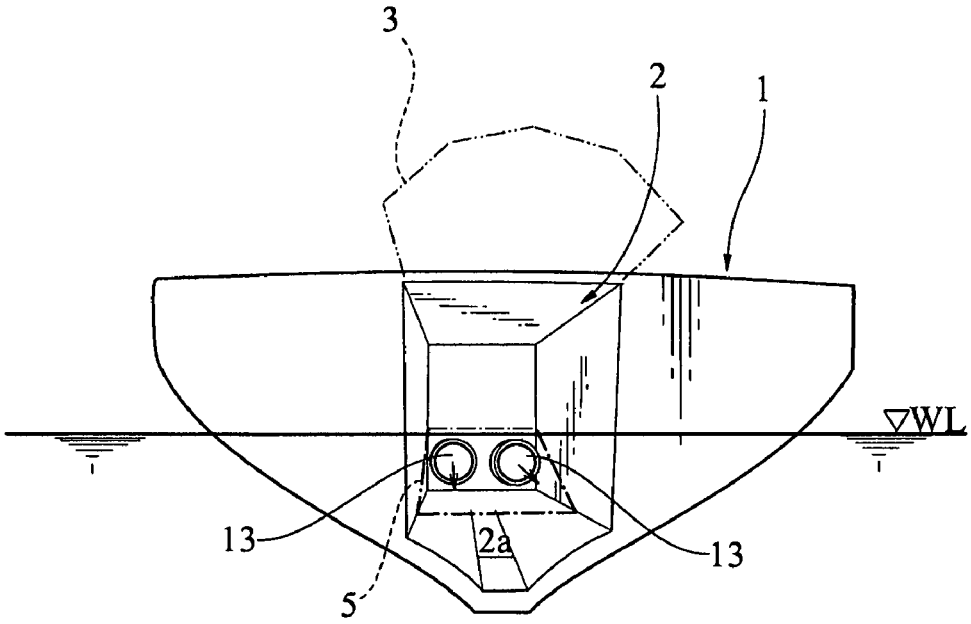
FIG. 5 is a perspective view illustrating positions and arrangements of the water outlet ports of the launch and recovery apparatus as shown in FIG. 3.

FIG. 3 depicts cross-sectional views showing the stern part of the marine vessel provided with the launch and recovery apparatus according to the present invention. FIGS. 4 and 5 are perspective views illustrating positions and arrangements of water-intake and water-outlet ports.

The dock 2 as shown in FIG. 3 has an arrangement that is basically the same as that of the conventional dock as shown in FIGS. 1 and 2. However, the marine vessel 1 is provided with right and left water conduit devices 11 in a pair. Each of the devices 11 is constituted from the water intake port 12, the water outlet port 13 and a conduit 14.

As shown in FIGS. 3 and 4, the water intake port 12 opens on a side surface of the marine vessel 1 under the waterline. The port 12 is equipped with an openable water intake hatch 15. The hatch 15 can be driven in rotation about a pivot axis 15*a* (FIG. 3) between its fully opened and fully closed positions, so that the open area of the port 12 can be variably adjusted. The port 12 conducts the seawater to be introduced into the port 12.

While the marine vessel 1 makes headway at a high speed, a dynamic pressure of the seawater corresponding to the headway speed of the vessel 1 acts on the hull. Therefore, the seawater on a side of the hull flows into the port 12 when the gate 3 and the hatch 15 are opened in the high-speed headway navigation. The conduit 14 is arranged to conduct the intake water to the water outlet port 13, and the water effluent from the port 13 flows into the dock from a part of the bow-side partition wall. As shown in FIGS. 3 and 5, the port 13 is positioned under the slipway 5 and is opened below a standard water level of the dock 2. The slipway 5 is provided with openings (not shown), and the seawater effluent from the port 13 flows through these openings.

When the gate 3 and the hatch 15 are opened during navigation of the marine vessel 1, the seawater surrounding the hull passively flows into the port 12, passes through the conduit 14 and flows from the port 13 into the dock. The water effluent from the port 13 flows into a waterway 2*a* of the dock 2 through the openings of the slipway 5, and then, flows outboard through the stern opening of the dock 2. Thus, backward water streams parallel with the center axis of the dock 2 are generated in the dock.

The variation of the water level in the dock is shown in FIG. 6, which appears when the marine vessel 1 makes headway at a speed of 20 knots.

Results of measurement of the water level in the dock are indicated in FIG. 6, wherein the opening ratio of the port 12 has been adjusted under control of opening of the hatch 15 to be 0%, 10% and 20%, respectively. The results of measurement, which are obtained in a condition of "opening ratio=0%", can be deemed to be measurement results of the conventional dock 2 without the water conduit device 11.

When the opening ratio is set to be 10%, the water level of the waterway 2*a* is significantly raised, in comparison with the water level obtained when the opening ratio is set to be 0%. When the opening ratio is set to be 25%, the water level of the waterway 2*a* is further raised. The difference in the water level substantially disappears between the flow field II in the dock and the flow field III out of the dock. That is, rising of the water surface of the flow field III near the gate substantially disappears.

The relationships between the headway speed of the marine vessel 1 and the water level are shown in FIG. 7. When the opening ratio of the water intake port is set to be 25%, the seawater through the conduit 14 increases in its velocity in relation with increase of the headway speed. The headway speed is raised up to 20 knots and is kept at this speed, and thereafter, the velocity of the water through the conduit 14 is stable.

The water level in the dock (the flow field I) tends to temporarily descend when the headway speed is raised. However, after the headway speed is fixed at 20 knots, the water level in the dock is stable at a level somewhat higher than the level obtained before increase of the headway speed. Therefore, the water levels inside and outside of the dock are equalized, so that the seawater rising near the gate (the flow field III) substantially disappears.

That is, the backward water stream discharged from the stern opening of the dock 2 gives the horizontal and backward momentum to the flow field III, whereby rising of the stern wave is restricted. The backward water stream also acts to raise the water level of the waterway 2*a* in the dock so that the water level in the dock is prevented from descending.

According to such an arrangement, rising of the seawater disappears in the stern flow field III, which may, otherwise, result in difficulty of the entry of the boat 10 into the dock. Therefore, it is possible to launch and recover the boat 10 during navigation of the vessel 1 at a high headway speed. Since the backward water stream is normally formed in the dock, it is not necessary for the operator of the boat 10 to rapidly reduce a thrust of the boat 10 when entering the dock. Also, difficult steering or turning maneuvering is not imposed on the operator. Further, a problem of impingement of the boat 10 against the end wall of the dock (i.e., a problem of excessive impact caused by the impingement), which results from rapid reduction of the resistance of the headway movement, can be eliminated. In addition, even if the gate 3 is opened in a following wave condition, impact of the hull resulting from impingement of the waves against the end wall of the dock is avoidable. This is because the backward water streams are constantly generated in the dock, which encounters the oncoming waves in the dock.

Further, the launch and recovery apparatus with the aforementioned arrangement introduces the surrounding water into the dock 2, with use of the dynamic pressure of the seawater acting on the hull in relation with the headway speed. Therefore, the backward flow is caused passively in the dock. According to this apparatus, electric power for causing or ensuring the water stream in the dock is not required, and provision of any additional function on the boat 10 is unnecessary, and therefore, this apparatus is practically very advantageous. When the water stream is formed, the headway resistance of the marine vessel 1 is somewhat increased, and therefore, the headway speed is slightly reduced. However, such reduction of the headway speed is merely an order of speed up to 1 knot (e.g., 0.5 knot).

Figure 8:
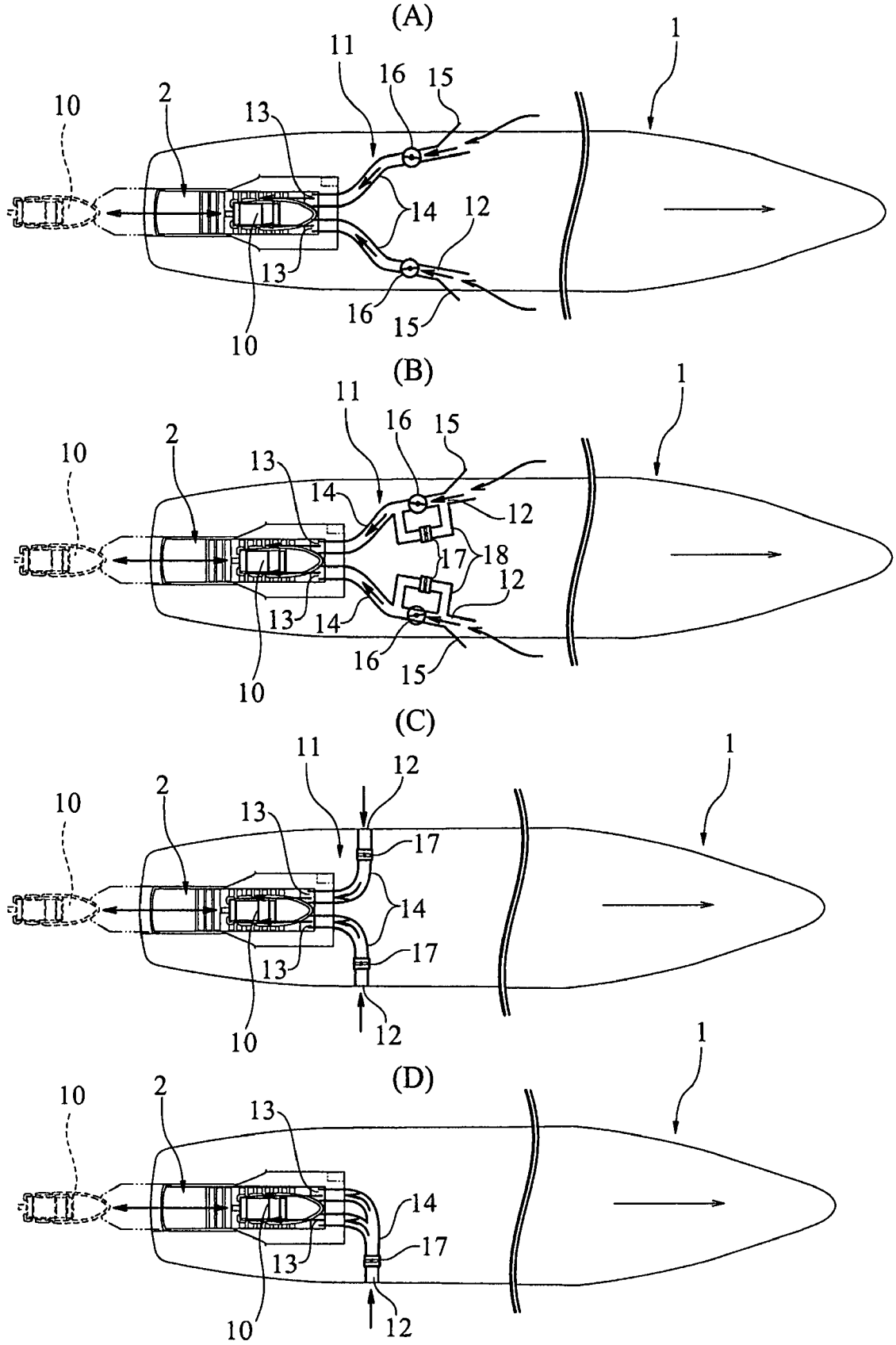
FIG. 8 depicts plan views of the vessel showing modifications of a water conduit device.

FIG. 8 is a plan view of the marine vessel 1 showing modifications of the conduit device 11.

The device 11 as shown in FIG. 8(A) is provided with control valves 16 for variably controlling the fluid resistances of the conduits 14. The backward water streams in the dock are controlled by adjusting the opening ratios of the water intake ports 12 and those of the valves 16.

The device 11 as shown in FIG. 8(B) is provided with bypass fluid passages 18 for bypassing the seawater. Each of the bypass passages 18 is equipped with a seawater pumping device 17. For example, the device 17 is an axial flow pump which feeds the seawater under pressure when the valve 16 is fully closed. If desired, the passage 18 may be provided with a control valve (not shown) on the suction side of the device 17 and/or the delivery side thereof.

According to the conduit device 11 equipped with the pumping device 17, the water stream in the dock can be actively produced by shut-off of the valve 16 and operation of the device 17, during stoppage state or low-speed headway navigation of the marine vessel 1. As previously described, the water stream in the dock, which is caused in the stoppage or low-speed headway condition, facilitates operation for entry of the boat into the dock. Further, the streams encounter the waves entering the dock, thereby relieving the impacts on the hull resulting from impingement of the waves against the end wall of the dock.

Each of the conduit devices 11 as shown in FIGS. 8(C) and 8(D) has the conduit 14 equipped with the seawater pumping device 17. The water intake port or ports 12 may be located on both sides of the hull or only one side of the hull. With use of the pumping device 17, a wide variety of designs can be employed with respect to a position of the port 12, a plumbing route of the conduit 14 and so forth.

Figure 9:
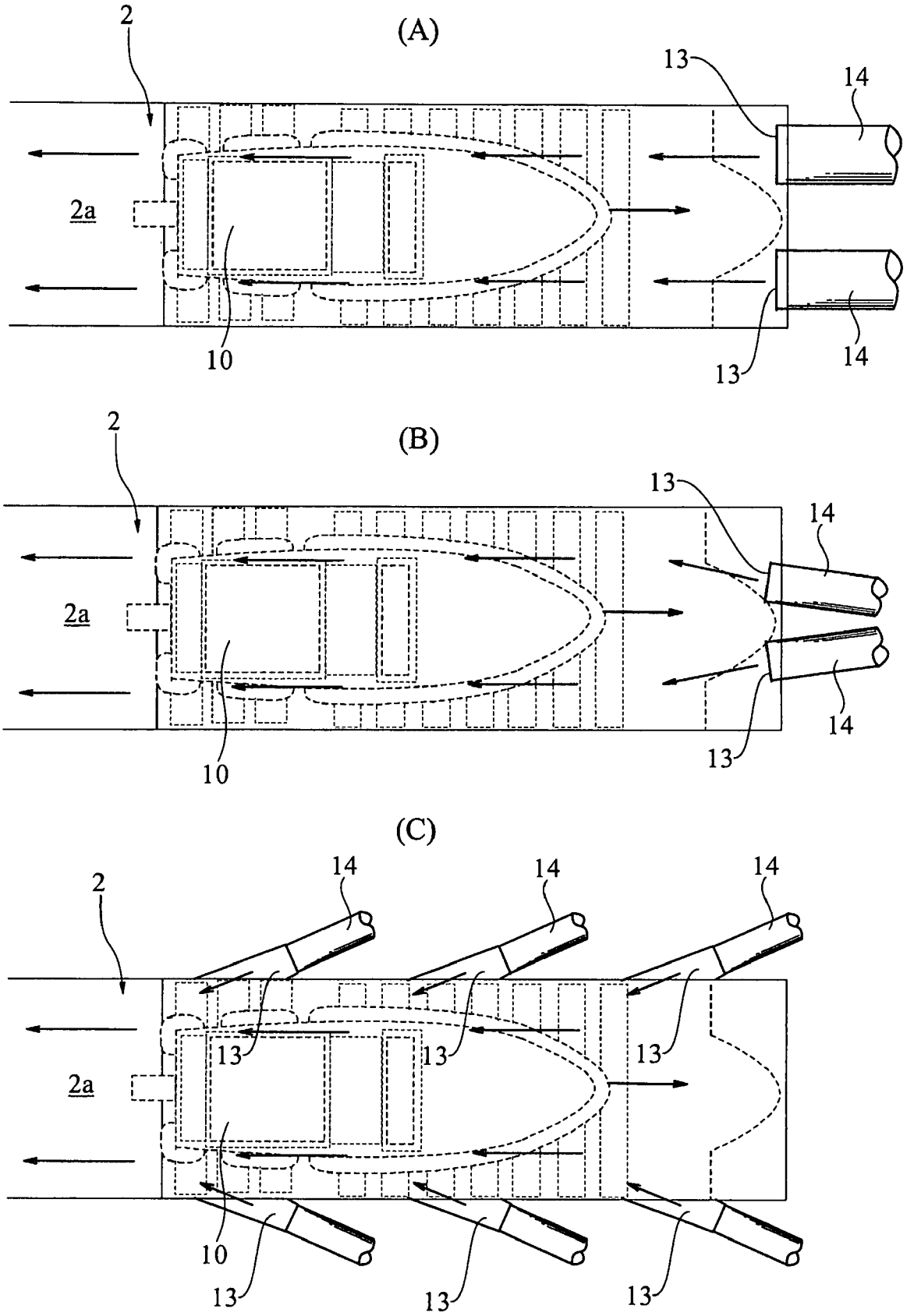
FIG. 9 depicts enlarged plan views of the dock, each showing a layout of the water outlet ports.

FIG. 9 depicts enlarged plan views of the dock 2, each showing a layout of the water outlet ports 13.

In FIG. 9(A), the ports 13 are disposed on the end wall portion of the dock 2 in parallel. The parallel water streams are generated in an axial direction of the hull.

In the arrangement as shown in FIG. 9(B), the ports 13 are disposed on the center area of the end wall portion of the dock 2 in relatively close proximity to each other. Each of the ports 13 ejects or delivers the water in a direction at a predetermined angle with respect to the center axis of the dock 2. Appropriate setting of this angle allows divergent water streams to be caused in the end zone of the waterway 2*a*. Alternatively, the port 13 may be provided with means for deflecting the water stream, such as a guide member, vane or blade.

The divergent water streams in the end zone of the waterway 2*a* give the entering boat 10 centering forces which act to urge the boat 10 in alignment with the center axis of the dock 2.

In the arrangement as illustrated in FIG. 9(C), the ports 13 are disposed on each of the side walls of the dock 2 in positions. In a case where the ports 13 cannot be located on the end zone of the dock 2, the ports 13 may be positioned on the side walls of the dock 2 so that the backward water streams are caused in the waterway 2*a*.

Figure 10:
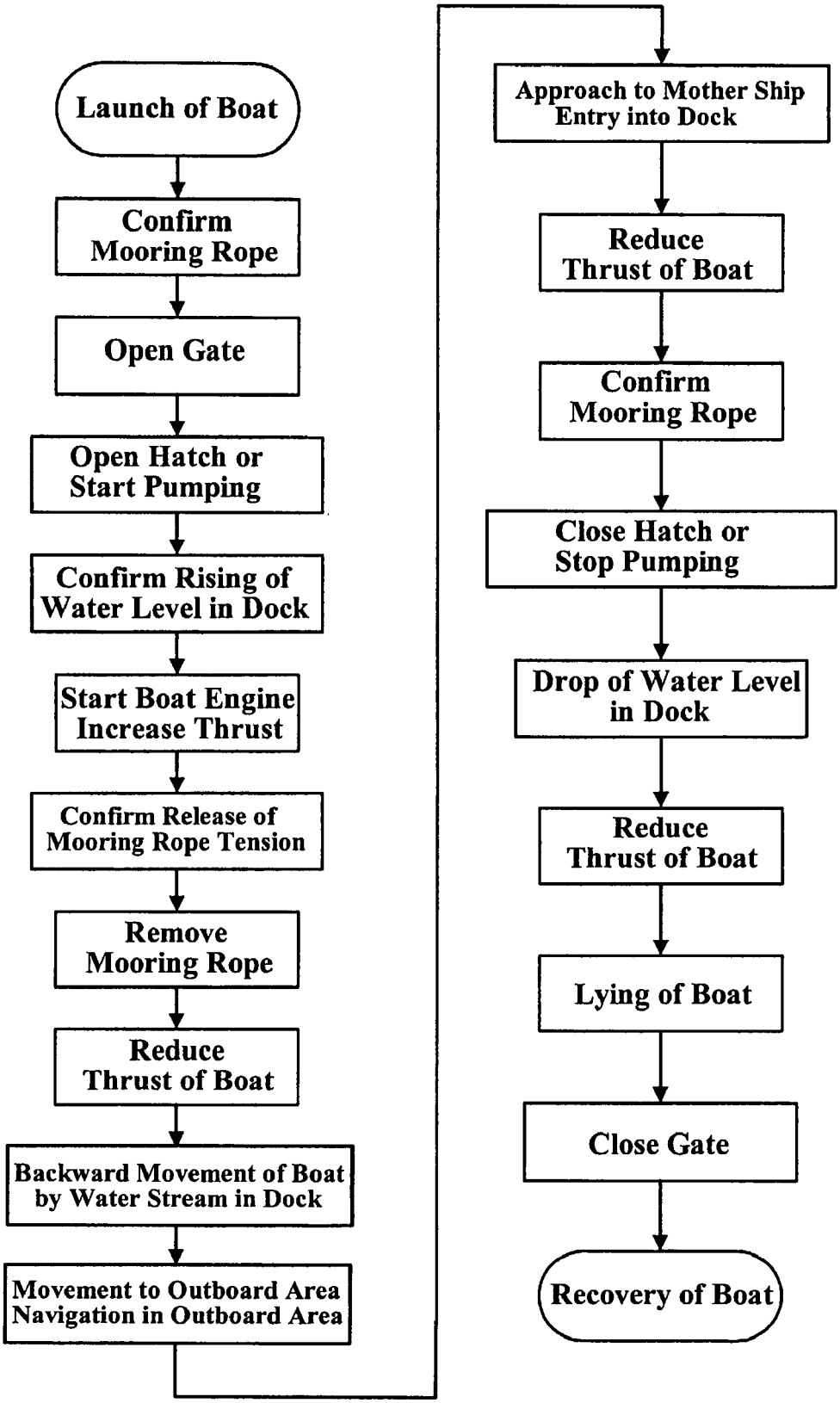
FIG. 10 is a flow chart showing a launch and recovery process carried out with use of the launch and recovery apparatus according to the present invention.

FIG. 10 is a flow chart showing a launch and recovery process with use of the launch and recovery apparatus as set forth above.

When the boat 10 stowed in the dock 2 is to be launched outboard of the vessel, the gate 3 is opened after confirmation of a mooring rope, and then, the seawater is ejected or delivered through the outlet port 13 by opening of the hatch 15, opening of the valve 16, or operation of the pumping device 17. After rising of the water level in the dock is confirmed, an engine of the boat, such as a water jet engine, is started, and the thrust of the boat 10 is gradually increased by throttle control of the engine. When the tension of the mooring rope completely disappears owing to increase of the thrust of the boat 10, the mooring rope is released and the thrust is gradually reduced by deliberately adjusting the throttle of the engine, whereby the boat 10 slowly moves backward under the action of the water streams in the dock and exits from the stern opening of the dock 2 to the outboard area. If desired, the boat 10 may be driven backward by its astern power when the boat exits the vessel 1, in view of an effect of a propeller race of the vessel 1.

After a predetermined outboard action or role of the boat 10 is completed, recovery of the boat 10 to the dock 2 is performed. The boat 10 approaches the dock 2 from the rear of the vessel 1 and enters the dock 2. As previously described, the problems on rising of the water surface near the gate and rapid reduction of the headway resistance occurring upon entry of the boat into the dock are overcome by the effect of the water streams in the dock. Therefore, the boat 10 can smoothly enter the dock 2 while its thrust is deliberately reduced by throttle control. After the mooring rope is confirmed, ejection or delivery of the seawater from the port 13 is stopped by closing the hatch 15, shutting the valve 16 or stopping the operation of the pumping device 17.

As the suction effect acts on the water in the dock, owing to the headway navigation of the vessel 1, the water level in the dock gradually lowers. The thrust of the boat 10 is gradually reduced by throttle control, until the boat 10 lies on the slipway 5. Thereafter, the gate 3 is closed and thus, the launch and recovery process is completed.

In a case where the vessel 1 is navigated at a relatively high headway speed, the water level in the dock is discharged outboard by the suction effect, before the gate is closed. If desired, the electric winch 20 may be used for obtaining a suitable traction force of the boat 10, upon lying-on or lifting of the boat 10.

Figure 11:
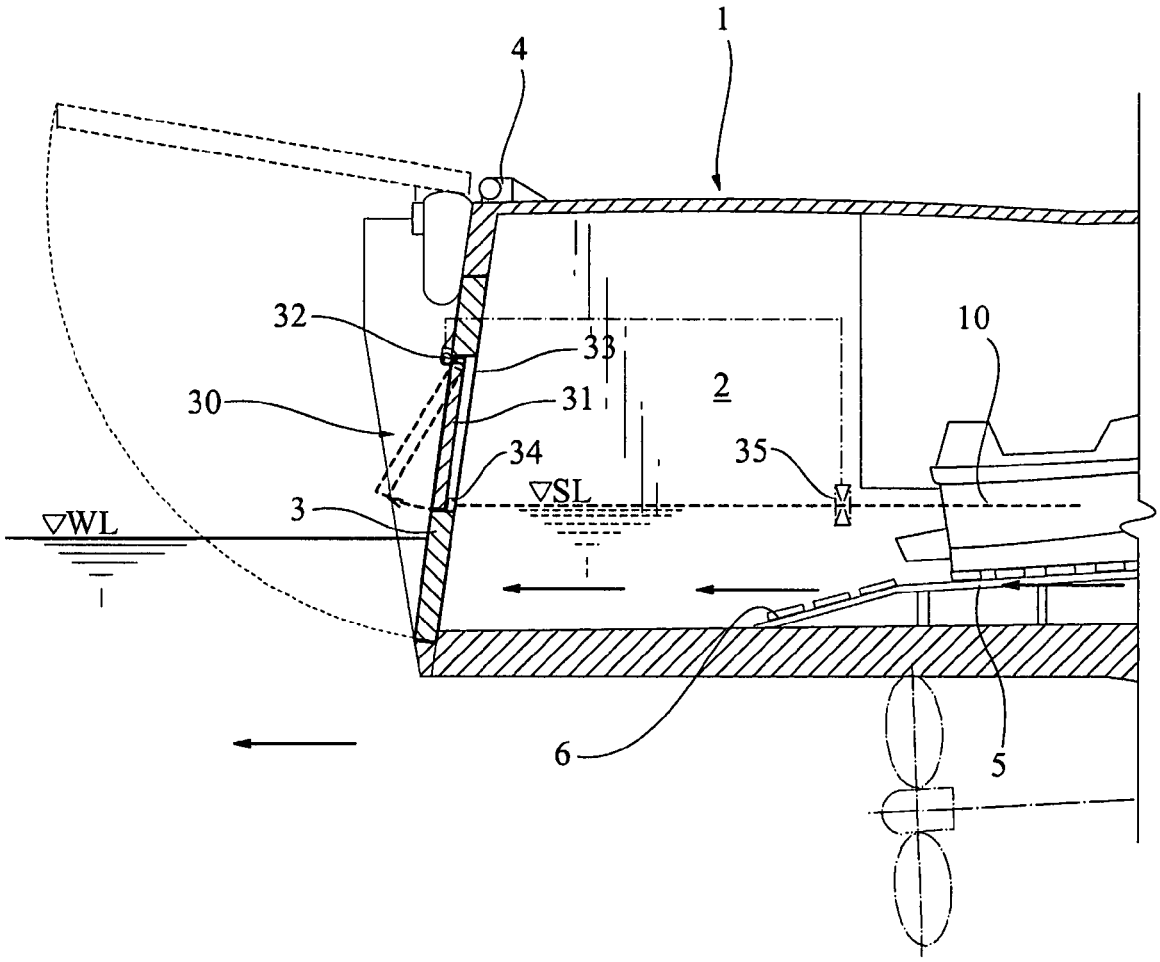
FIG. 11 is a vertical cross-sectional view illustrating an arrangement of a water level limiting system provided on a gate.

FIG. 11 is a cross-sectional view illustrating an arrangement of a water-level limiting system provided on the gate 3.

The water stream is caused inside of the gate in association with the closing or opening operation of the gate 3, as previously described. However, if such a water stream occurs when the gate is closed, the water level inside of the gate may be extraordinarily raised. Therefore, the gate 3 has a water-level limiting device 30 as means for preventing the water level inside of the gate from being extraordinarily raised.

The device 30 is constituted from an opening 33 of the gate 3, a water level limiting hatch 31 for opening and closing the opening 33, a hinge means 32 pivotably supporting the hatch 31, and a stopper 34 abutting against a lower end portion of the hatch 31. The stopper 34 extends over the whole width of the opening 33. The limit of water level SL depends on an upper end level of the stopper 34.

If an unexpected water stream occurs in the dock by malfunction of the device 11 and so forth when the gate 3 is closed, the water level inside of the gate is raised. When the water level exceeds the limit SL, the hatch 31 pivotally moves outside about a pivot axis of the hinge means 32, owing to a water pressure inside of the gate. Therefore, the water inside of the dock overflows a dam of the stopper 34 to the outboard area, and the water level inside of the dock is limited under the limit SL.

Alternatively, a water level detector 35 is located in the dock and the hinge means 32 is designed to be an electric or hydraulic type of hinge driving device. In such a case, when the detector 35 detects the water level exceeding the limit SL, the hinge means 32 forcibly opens the hatch 31 for discharging the water from the dock to the outboard area.

Figure 12:
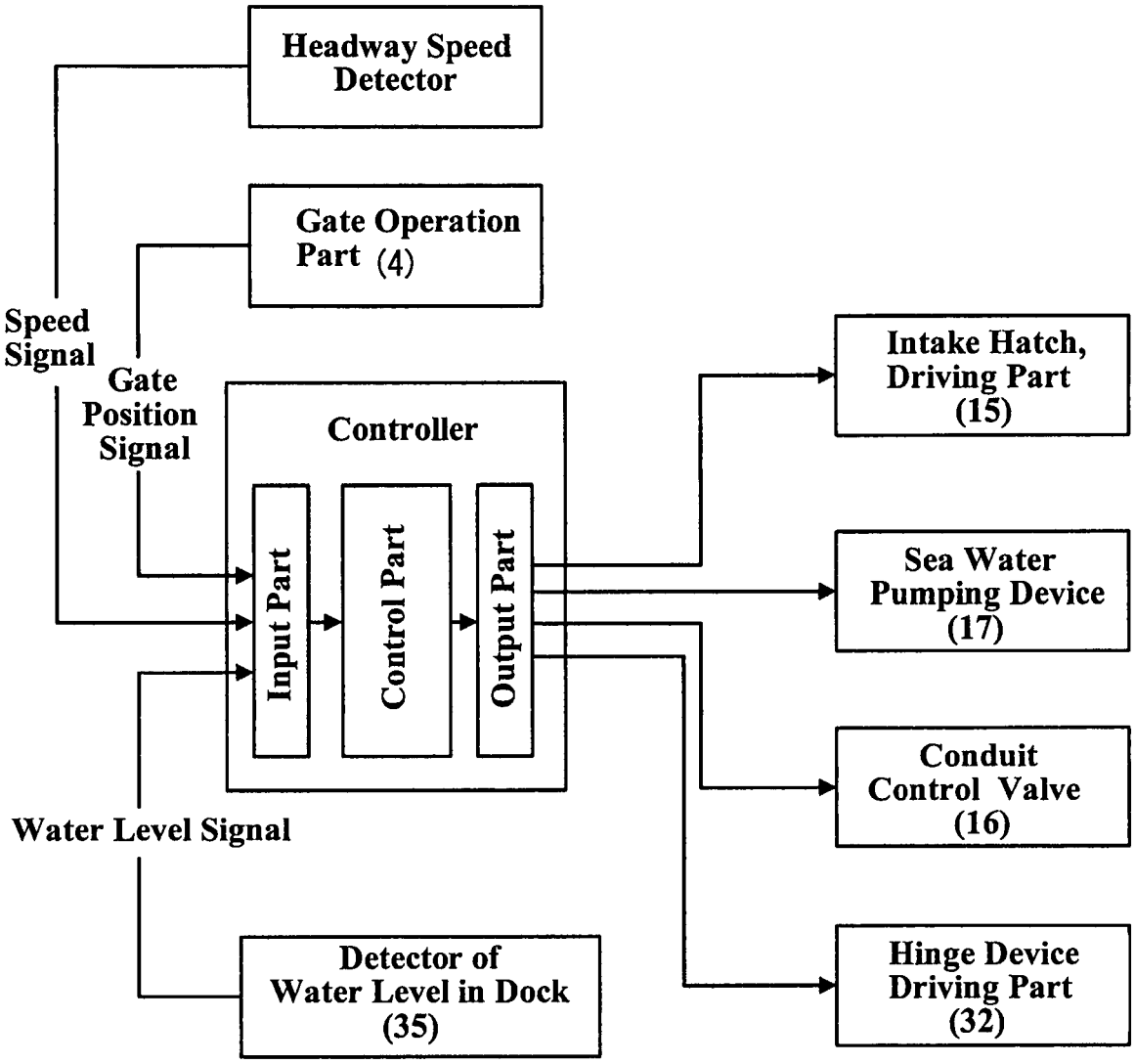
FIG. 12 is a block diagram illustrating an arrangement of a controller for the launch and recovery apparatus.
Figure 13:
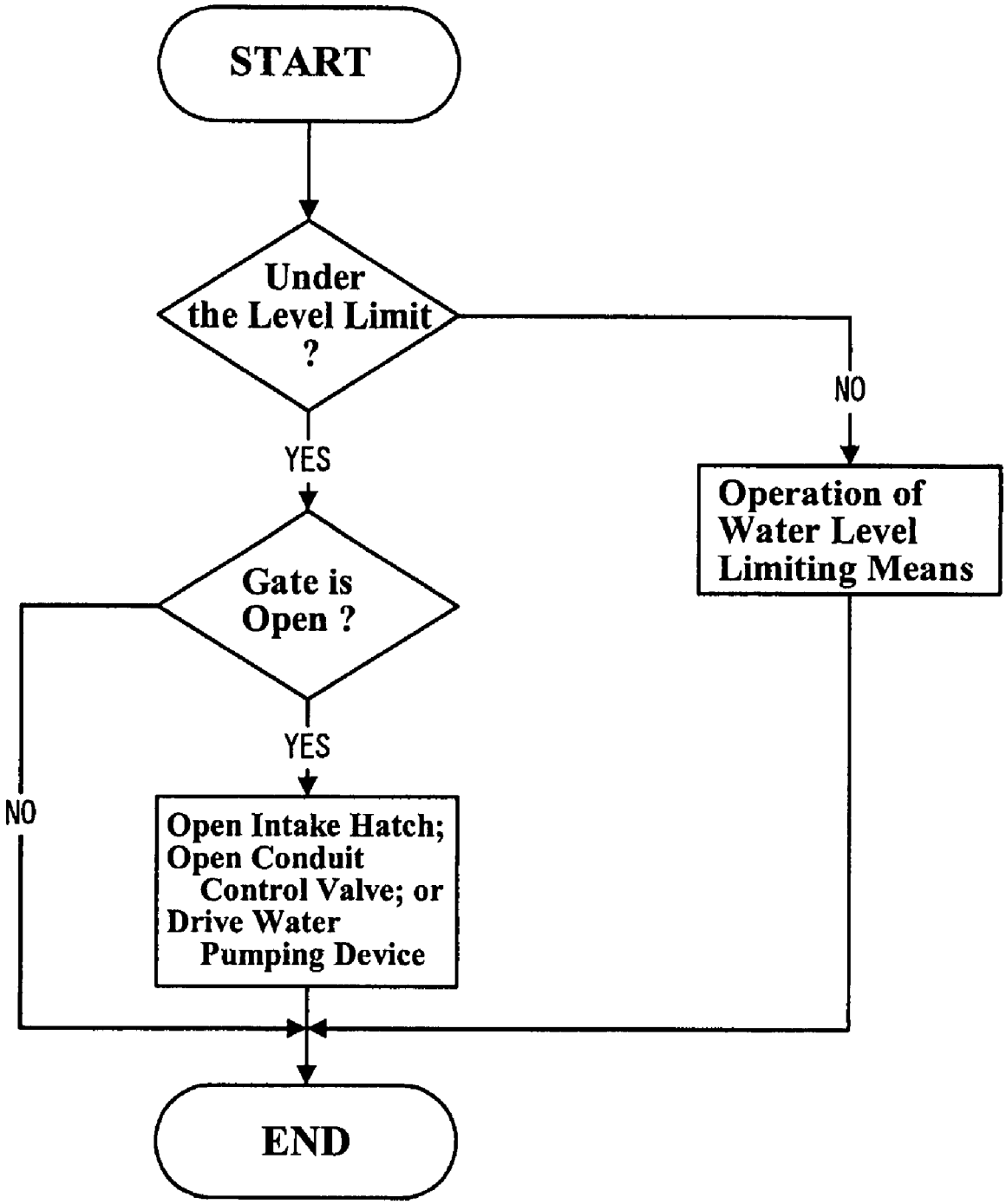
FIG. 13 is a flow chart showing a manner of control carried out when the boat is to be launched.
Figure 14:
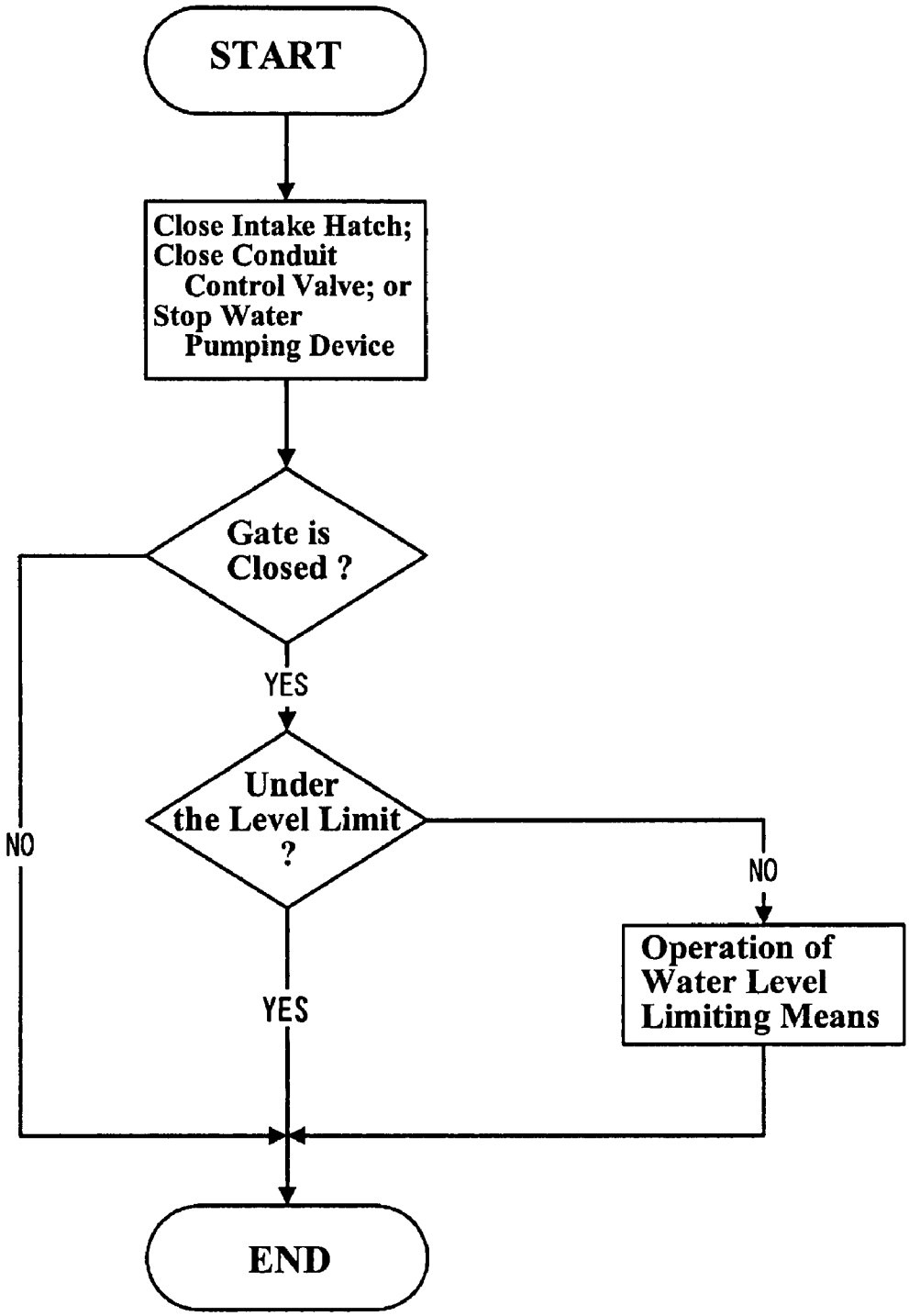
FIG. 14 is a flow chart showing a manner of control carried out when the boat is to be recovered.

FIG. 12 is a block diagram showing an arrangement of a controller for the launch and recovery apparatus, and FIGS. 13 and 14 are flow charts showing a manner of control of the launch and recovery apparatus. In the arrangement of the controller as shown in FIG. 12, it is assumed that the device 11 is provided with the hatch 15, the valve 16 and the device 17 as shown in FIG. 8 and that the hinge means 32 of the hatch 31 as shown in FIG. 11 is designed to be provided with the aforementioned driving device.

The conduit device 11 is provided with a controller which carries out control of the opening ratio of the hatch 15 and so forth. As shown in FIG. 12, a gate position (open/close) signal which represents the position of the gate 3 is inputted to an input part of the controller from a driving part of the gate 3. Further, a water level signal of the detector 35 (FIG. 11) in the dock is inputted to the input part of the controller.

A headway speed signal representing the current or present headway speed of the vessel 1 is inputted to the input part of the controller from a headway speed detector. A control part of the controller performs operation to obtain the flow rate of the conduit 14 for formation of suitable water streams in the dock. The controller further carries out setting of the opening ratio of the hatch 15, the opening ratio of the valve 16, or the power of the device 17, and outputs a driving signal (or inoperative signal) to a driving part of each of the hatch 15, the valve 16 and the device 17.

The control part also outputs the driving signal to a driving part of the hinge means 32 when the water level signal indicates an abnormal water level, and the hinge means 32 forcibly opens the hatch 31 (FIG. 11). Further, the hatch 15 or the valve 16 is closed, or operation of the device 17 is forcibly stopped.

In FIG. 13, a manner of control for launch of the boat is shown. If the controller recognizes opening of the gate 3 when the water level in the dock is lower than the water level limit, the controller outputs the driving signals to the driving parts of the hatch 15, the valve 16 and the device 17. The conduit device 11 initiates the operation for conducting the water as set forth above, so that the aforementioned backward water stream is generated in the dock.

A manner of control performed for recovery of the boat is shown in FIG. 14. The controller outputs the closing or inoperative signals to the driving parts of the hatch 15, the valve 16 and the device 17. The conduit device 11 ceases to conduct the water, so that the water level in the dock lowers down to the normal level which depends on the opening or closing operation of the gate, the headway speed of the vessel, the outboard wave condition and so forth. If an abnormal water level (extraordinary high water level) is detected in the dock after the gate is closed, the hatch 31 (FIG. 11) is opened as previously described.

Thus, the controller functions as interlocking means which associates the opening/closing operation of the gate 3 with the operation of the conduit device 11. In a case where the launch and recovery apparatus includes the active means for limiting the water level, the controller functions as means for relating the water level in the dock and the operation of the conduit device 11 with each other.

Although the present invention has been described as to a preferred embodiment, the present invention is not limited thereto, but may be carried out in any of various modifications or variations without departing from the scope of the invention as defined in the accompanying claims.

For example, the configurations of the intake hatches, intake ports and outlet ports, the positions thereof, and so forth, may be optimized from hydrodynamic viewpoints so as to be suitable for the structures and configurations of the hull and so forth. Therefore, various modifications or variations of designs of these elements can be employed.

Further, the dock illustrated in the drawings is closed at its top portion by a deck, but the present invention can be applied to a dock with its top portion being opened.

Furthermore, in the embodiment as set forth above, the present invention is applied to the launch and recovery apparatus with the single dock, but the present invention can be equally applied to the apparatus with a plurality of docks.

INDUSTRIAL APPLICABILITY

The present invention is applied to an apparatus and method for launch and recovery of a boat, which is of a dock system and which is located in a stern part of a marine vessel, wherein the boat is launched or recovered through a stern opening. According to the present invention, it is possible to carry out launching and recovering of the boat with use of the stern dock while the vessel makes headway at a high speed. Further, in accordance with the present invention, launching and recovering operations of the boat can be relatively easily performed by means of the stern dock, even in low headway speed navigation or stoppage condition, or in navigation under a following-wave state.

The invention claimed is:

1. An apparatus for use in a dock system of a marine vessel for performing launch and recovery of a boat stowed in the dock system, while the marine vessel makes headway, wherein the dock system includes a dock at a stern part of the marine vessel for containing the boat therein and a stern opening in the dock for launching the boat outboard therethrough and for recovering the boat by entry of the boat therethrough into the dock, the apparatus comprising:

a conduit device having an outlet port disposed on one of a front end wall portion of the dock and a side wall portion of the dock and opening to the dock, for carrying out an intake of water around the vessel and delivering the water through the outlet port to the dock during entry of the boat into the dock, and forming a backward water stream directed toward the stern opening in a waterway inside of the dock for discharge to the outboard area through the stern opening, wherein said conduit device includes a water intake port which opens on an exterior lateral surface of a hull of the marine vessel under a water level for receiving from the intake port a relative water current caused along the hull by the headway navigation of the vessel, and means for closing and opening the intake port to control the intake of water and conducting the water current to be introduced into the intake port.

2. The apparatus as defined in claim 1, wherein said conduit device includes the water intake port for passively receiving the relative water current by headway navigation of the vessel; and a water conduit for fluid-communication between the water intake port and the outlet port, and the intake of the water is effected by a dynamic pressure of the relative water current around the vessel and the backward water stream is generated in the dock.

3. The apparatus as defined in claim 1, wherein said conduit device includes a water conduit for fluid-communication between the water intake port and the outlet port, and a forcible pumping device provided on the conduit to draw the water through the water intake port and deliver the backward water stream through the outlet port.

4. The apparatus as defined in claim 1, further comprising a water level limiting means for discharging the water inside of a stern gate of the dock to the outboard area when a water level inside of the stern gate exceeds a predetermined limit of the water level.

5. The apparatus as defined in claim 1, wherein plural outlet ports are disposed on the front end wall portion of the dock so as to form parallel backward water streams in the waterway inside of the dock.

6. A method for launch and recovery of a boat stowed in a marine vessel, using the device of claim 5, comprising the steps of:

intaking water around the marine vessel, delivering a flow of the intake water to the dock, so that a backward water stream to be discharged through the stern opening to the outboard area is generated in the dock, and forming the parallel backward water streams, directed from the front end wall portion of the dock toward the stern opening, in the waterway inside of the dock.

7. The apparatus as defined in claim 1, wherein the outlet port is arranged to cause the backward water stream to be oriented in a direction oblique to a center axis of the dock.

8. A method for launch and recovery of a boat stowed in a marine vessel, using the device of claim 1, comprising the steps of:

intaking water around the vessel and delivering a flow of the intake water to the dock, so that a backward water stream to be discharged through the stern opening to the outboard area is generated in the dock.

9. The method as defined in claim 8, further comprising the step of forcibly or naturally discharging the water inside of a stern gate of the dock to the outboard area, when a water level inside of the stern gate exceeds a predetermined limit of the water level.

10. The method as defined in claim 8, further comprising the step of delivering the backward water stream, which is oriented in a direction oblique to a center axis of the dock, through the outlet port in the dock to the waterway in the dock.

11. An apparatus for use in a dock system of a marine vessel for performing launch and recovery of a boat stowed in the dock system, while the marine vessel makes headway, wherein the dock system includes a dock at a stern part of the marine vessel for containing the boat therein and a stern opening in the dock for launching the boat outboard therethrough and for recovering the boat by entry of the boat therethrough into the dock, the apparatus comprising:

a conduit device having an outlet port disposed on one of a front end wall portion of the dock and a side wall portion of the dock and opening to the dock, for carrying out an intake of water around the vessel and delivering the water through the outlet port to the dock during entry of the boat into the dock, and forming a backward water stream directed toward the stern opening in a waterway inside of the dock for discharge to the outboard area through the stern opening, and a controller which controls the water stream in the dock in association with operation of a stern gate of the dock and a headway speed of the marine vessel.

12. A method using an apparatus for launch and recovery of a boat stowed in a marine vessel, while the marine vessel makes headway, the marine vessel including a dock at a stern part of the marine vessel for containing the boat therein and a stern opening in the dock for launching the boat outboard therethrough and for recovering the boat by entry of the boat therethrough into the dock, the apparatus including a conduit device having an outlet port disposed on one of a front end wall portion of the dock and a side wall portion of the dock and opening to the dock, for carrying out an intake of water around the vessel and delivering the water through the outlet port to the dock during entry of the boat into the dock, and forming a backward water stream directed toward the stern opening in a waterway inside of the dock for discharge to the outboard area through the stern opening, the method, comprising the steps of:

intaking water around the marine vessel;

delivering a flow of the intake water to the dock, so that the backward water stream to be discharged through the stern opening to the outboard area is generated in the dock;

passively receiving from an intake the relative water current caused around the vessel by headway navigation of the marine vessel;

conducting the water current to the outlet port which opens to the dock; and delivering the water into the dock through the outlet port, so that the backward water stream is formed in the dock, corresponding to the headway speed of the vessel and the resistance for intake of the water current.

13. A method using an apparatus for launch and recovery of a boat stowed in a marine vessel, while the marine vessel makes headway, the marine vessel including a dock at a stern part of the marine vessel for containing the boat therein and a stern opening in the dock for launching the boat outboard therethrough and for recovering the boat by entry of the boat therethrough into the dock, the apparatus including a conduit device having an outlet port disposed on one of a front end wall portion of the dock and a side wall portion of the dock and opening to the dock, for carrying out an intake of water around the vessel and delivering the water through the outlet port to the dock during entry of the boat into the dock, and forming a backward water stream directed toward the stern opening in a waterway inside of the dock for discharge to the outboard area through the stern opening, the method, comprising the steps of:

intaking water around the marine vessel;

delivering a flow of the intake water to the dock, so that the backward water stream to be discharged through the stern opening to the outboard area is generated in the dock;

actively receiving from an intake port a relative water current caused around the marine vessel by headway navigation of the marine vessel, by means of a forcible pumping device; and feeding the water current under pressure to the outlet port which opens to the dock, so that the water is delivered into the dock through the outlet port, whereby the backward water stream under control of the pumping device is formed in the dock.

14. A method using an apparatus for launch and recovery of a boat stowed in a marine vessel, while the marine vessel makes headway, the marine vessel including a dock at a stern part of the marine vessel for containing the boat therein and a stern opening in the dock for launching the boat outboard therethrough and for recovering the boat by entry of the boat therethrough into the dock, the apparatus including a conduit device having an outlet port disposed on one of a front end wall portion of the dock and a side wall portion of the dock and opening to the dock, for carrying out an intake of water around the vessel and delivering the water through the outlet port to the dock during entry of the boat into the dock, and forming a backward water stream directed toward the stern opening in a waterway inside of the dock for discharge to the outboard area through the stern opening, the method, comprising the steps of:

intaking water around the marine vessel;

delivering a flow of the intake water to the dock, so that the backward water stream to be discharged through the stern opening to the outboard area is generated in the dock;

controlling generation and cessation of the water stream in the dock in association with operation of a stern gate of the dock; and controlling augmentation of the stream in the dock in dependence on a water intake resistance or a pumping power.

* * * * *